US007290868B2

(12) United States Patent
Sakamoto et al.

(10) Patent No.: US 7,290,868 B2
(45) Date of Patent: Nov. 6, 2007

(54) INKJET HEAD WITH FORMED EXTERNAL CIRCUIT CONNECTING ELECTRODES

(75) Inventors: Yasuhiro Sakamoto, Matsubara (JP); Tomoyuki Sagara, Sakurai (JP); Shigeaki Kakiwaki, Nara (JP); Hirotsugu Matoba, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 329 days.

(21) Appl. No.: 10/520,856

(22) PCT Filed: Mar. 10, 2004

(86) PCT No.: PCT/JP2004/003054

§ 371 (c)(1),
(2), (4) Date: Jan. 10, 2005

(87) PCT Pub. No.: WO2004/080720

PCT Pub. Date: Sep. 23, 2004

(65) Prior Publication Data

US 2006/0071972 A1 Apr. 6, 2006

(30) Foreign Application Priority Data

Mar. 11, 2003 (JP) ..... 2003-065708

(51) Int. Cl.
*B41J 2/45* (2006.01)

(52) U.S. Cl. ..... 347/86; 347/40; 347/54; 347/58; 347/68; 347/69; 347/70

(58) Field of Classification Search ..... 347/69, 347/10, 54, 57, 58, 70, 72; 310/328, 365
See application file for complete search history.

(56) References Cited

U.S. PATENT DOCUMENTS 5,825,383 A * 10/1998 Abe et al. ..... 347/54
5,988,799 A * 11/1999 Abe et al. ..... 347/68
6,547,375 B2 * 4/2003 Isono et al. ..... 347/69
6,802,596 B2 * 10/2004 Higuchi et al. ..... 347/68
7,066,582 B2 * 6/2006 Deguchi et al. ..... 347/68
7,156,503 B2 * 1/2007 Isono et al. ..... 347/69
2002/0080214 A1 6/2002 Higuchi et al.
2004/0174414 A1 * 9/2004 Tanikawa et al. ..... 347/70
2005/0068374 A1 * 3/2005 Sagara ..... 347/58
2005/0179724 A1 * 8/2005 Salt et al. ..... 347/40

FOREIGN PATENT DOCUMENTS

| | | |
|---|---|---|
| JP | 04-259563 | 9/1992 |
| JP | 04-307254 | 10/1992 |
| JP | 05092561 A * | 4/1993 |
| JP | 09-094954 | 4/1997 |
| JP | 2002-178518 | 6/2002 |
| JP | 2002-210954 | 7/2002 |
| JP | 2003-246058 | 9/2003 |

* cited by examiner

*Primary Examiner*—Patrick Assouad
*Assistant Examiner*—John P Zimmermann
(74) *Attorney, Agent, or Firm*—David G. Conlin, Esq.; David A. Tucker, Esq.; Edwards Angell Palmer & Dodge LLP

(57) ABSTRACT

There are provided driving electrodes (25) on walls (24) separating both sides of individual ink chambers (22) formed in the form of an array of multiple grooves. External circuit connecting electrodes (11) for connecting these driving electrodes (25) to an external circuit are formed on exposed surface regions of electrically conductive material (10) filled in the individual ink chambers (22) at a rear end portion of a head. Each of the aforesaid exposed surface regions has an area larger than the cross-sectional area of each ink chamber as measured along a direction perpendicular to the ink chamber array.

6 Claims, 16 Drawing Sheets

INKJET HEAD WITH FORMED EXTERNAL CIRCUIT CONNECTING ELECTRODES

TECHNICAL FIELD

The present invention relates to an ink jet head, an ink jet head module and a method of manufacturing the same. More particularly, the invention is concerned with a structure and a method of manufacturing externally connected electrodes and surrounding parts thereof.

BACKGROUND ART

Ink jet heads designed to eject ink by using shear mode of piezoelectric material have conventionally been proposed (refer to paragraph 0018 and FIG. 4 of Japanese Laid-open Patent Application No. H04-259563, for example). This kind of ink jet head includes an actuator member 100 having a plurality of grooves formed in an element of piezoelectric material which is formed by bonding pieces of the piezoelectric material of which piezoelectric properties have been oriented along a thickness direction such that the pieces of the piezoelectric material have opposite poling directions, a cover member 110 in which an ink supply opening 111 and a common ink chamber 112 are formed, and a nozzle plate 120 in which nozzle holes 121 are formed. As the actuator member 100, the cover member 110 and the nozzle plate 120 are bonded together, there are formed ink chambers 112 by the multiple grooves as shown in FIG. 13, for example. Inside the individual ink chambers 112, there are formed electrodes 101 for applying electric fields on walls separating the ink chambers.

A bottom surface of a rear half part 102 of the ink chamber 112 is machined into a curved shape. In the ink chamber 112, there is further formed a flat part 103 serving as an electrode extension part for achieving connection to an external circuit. The ink jet head and a driving IC 130 placed on a supporting substrate 140 are electrically connected by wire bonding technology by means of electrodes 104 formed on the flat parts 103 and aluminum wires 131. Alternatively, the ink jet head can be connected to a flexible board to which the driving IC 130 is connected by ACF (anisotropic conductive film) bonding technology, for example.

Next, a method of extending the electrodes in the individual ink chambers of the conventional ink jet head to the flat parts is explained with reference to FIGS. 14A and 14B. First, a dry film resist 150 is laminated and hardened on a primary surface of the actuator member 100. Next, grooves which will later become the ink chambers are formed by dicing the piezoelectric material to a depth of about half the thickness thereof by using a dicing blade 160 of a dicer. Then, the curved shape of the rear half part 102 of each ink chamber corresponding to the diameter of the dicing blade is formed by raising the dicing blade 160. Subsequently, only the dry film resist 150 is cut away at the flat part.

After an array of ink chambers has been formed in the aforementioned fashion, metal electrode material such as aluminum (Al) or copper (Cu) is deposited in each of the ink chambers by using sputtering or plating technology as shown in FIG. 14B. A metal film is also deposited in a similar way at openings in the dry film resist 150 formed at the curved bottom surface of the rear half part 102 and the flat part of each ink chamber to form electrodes for connection to the external circuit.

The actuator member 100 thus formed is driven in the shear mode by applying reverse-phased voltages to electrodes formed on opposite sides of each wall separating the ink chambers. Specifically, the walls separating the ink chambers deform in the shape of "<" at a joint surface of the ink chamber walls where the pieces of the piezoelectric material are bonded such that the poling directions of the piezoelectric pieces are symmetrically arranged, so that the volumetric capacity of each of the ink chambers varies. A variation in the volumetric capacity of the ink chamber results in a change in pressure applied to the ink in the ink chamber, whereby ink droplets are ejected through a fine nozzle located at a far end of the ink chamber.

In the aforementioned structure of the conventional ink jet head, only a front end section (front half portion) situated at the front of the ink supply opening 111 and the common ink chamber 112 constitutes a so-called active area which contributes to producing ink ejecting action, while a rear end section (rear half portion) including the ink supply opening 111 constitutes an area for supplying the ink. Further, the large-sized curved parts and flat parts 103 are used as extension electrodes for connecting the internal electrodes 101 of the individual ink chambers to the external circuit. In other words, these flat parts 103 are areas for establishing electrical connections to the electrodes which are connected to the driving IC 130.

In this structure of the ink jet head, portions other than the active area which contributes to the ink ejecting action are extremely large. This increases materials cost and, therefore, there has been a problem that the ink jet head could not be manufactured at low cost.

In addition, as it is necessary to extend the electrode 101 in each ink chamber up to the flat part 103 on the piezoelectric material like PZT having a high dielectric constant, the ink jet head will have a large capacitance. For this reason, a drive pulse waveform applied for driving the actuator becomes unsharp, leading to a problem that it becomes difficult to achieve high-speed printing by driving the actuator at high speed.

Although it is possible to improve unsharpness of the applied driving waveform by increasing an applied voltage, the amount of heat generated by driving the actuator increases and the temperature of the actuator increases when the applied voltage is increased. Consequently, the viscosity of the ink changes, leading to a problem that it is impossible to perform high-precision printing in a stable manner. This approach would also develop such problems that a driving IC to which a high voltage can be applied is costly, durability is affected by early deterioration of properties of the piezoelectric material caused by application of the high voltage, and it is difficult to reduce power consumption.

Under these circumstances, a film having a low dielectric constant is preformed between the piezoelectric material and the electrodes in the portions other than the active area of the internal electrodes 101 of the individual ink chambers so that the capacitance produced by the portions other than the active area is lowered to an almost negligible level. However, an extremely expensive ECR-CVD system is needed to form an Si—N film having a low dielectric constant, for instance, by a low-temperature process on PZT which is a piezoelectric material having such a low Curie point as approximately 200° C. Thus, there has been a problem that inexpensive ink jet heads could not be manufactured due to an increase in manufacturing cost.

To cope with the foregoing problems, there is proposed a structure in which an area for extending an ink supply opening and internal electrodes of individual ink chambers is taken in a longitudinal direction of piezoelectric material as shown in FIG. 15, for example (refer to paragraph 0008 and FIG. 1 of Japanese Laid-open Patent Application No.

H09-094954, for example). According to this proposal, the ink supply opening for supplying ink is provided in a rear end section of an active area of the piezoelectric material and an electrode 101 inside each ink chamber 112 is extended along a side surface on an ink supply side or along a side surface on an ink ejecting side to establish electrical connections to electrodes 171 which are connected to a driving IC 170.

Since portions other than the active area of actuators 100 are so little that a reduction in materials cost can be achieved with respect to the piezoelectric material. However, the electrodes 101 inside the ink chambers 112 must be bent generally at right angles along side surfaces of the actuators to extend the electrodes outward. To achieve this, it is necessary to structure the individual actuators 100 in small pieces and form a metal film on the side surface of each actuator to establish an electrical connection to the electrode 101 of each ink chamber 112. Such a metal film forming process is extremely inefficient.

Furthermore, to separate the individual electrodes, it is necessary to carry out beforehand resist patterning or an electrode separation process by using a dicing technique or a YAG laser after forming an outward-extending unseparated electrode. This approach has a problem that it involves an extremely complex process which results in low productivity, a low manufacturing yield and an increase in manufacturing cost. In addition, there is a high potential that the electrodes extended outward will break in a later process at bent parts from where the electrodes are extended from the ink chambers 112 to the side surfaces of the individual actuators. Thus, this structure has had such problems as deterioration of manufacturing yield and low environmental reliability.

Aiming at a solution of these problems, the present Applicant has proposed an ink jet head in which electrodes for providing external connections are formed of electrically conductive material filled into ink chambers (refer to paragraphs 0067 to 0072 and FIG. 1 of Japanese Laid-open Patent Application No. 2002-178518, for example). FIG. 16 (FIGS. 16A-16C) illustrates the ink jet head, in which FIG. 16A is a cross-sectional front view, FIG. 16B is a cross-sectional view taken along a line X-X, and FIG. 16C is a cross-sectional view taken along a line Y-Y.

According to this proposal, the electrodes for establishing external connections are formed of electrically conductive material 105 filled into the ink chambers as shown in FIG. 16, so that it is made unnecessary to extend the internal electrodes of the ink chambers to the outside thereof unlike the case of the prior art. Since actuators 100 necessitate almost no portions other than an active area, it is possible to achieve a reduction in materials cost.

As the capacitance decreases, it becomes possible to increase driving frequency and thereby perform high-speed printing. Furthermore, since driving voltage can be decreased, it becomes possible to lower withstand voltage of a driving IC, making it possible to achieve a cost reduction of the driving IC and a reduction in power consumption for driving the same.

Due to demands for a further reduction in materials cost and higher-speed printing, however, there has been a move toward narrow-pitch design of ink jet heads in which individual ink chambers of an ink chamber array are arranged at smaller intervals. As a result of this move, the areas of the electrodes for establishing electrical connections to an external circuit decrease in the structure shown in FIG. 16.

For this reason, large increases or variations in connecting resistance could occur at electrical connections between the ink jet head and the external circuit, such as a flexible board, causing a problem that environmental reliability would deteriorate. Also, a driving waveform applied for driving the actuator becomes unsharp, leading to a problem that it becomes difficult to achieve high-speed printing by driving the actuator at high speed.

This invention has been made in consideration of the aforementioned situation. Accordingly, it is an object of the invention to provide a low-cost ink jet head which can be connected to an external circuit with low connecting resistance in a stable fashion, the ink jet head having high environmental reliability and a capability to perform high-speed printing.

DISCLOSURE OF THE INVENTION

To achieve the aforementioned object, an ink jet head includes a plurality of ink chambers arranged like parallel grooves, walls separating the aforesaid multiple ink chambers, driving electrodes provided on the aforesaid walls, the aforesaid driving electrodes being exposed individually in the aforesaid multiple ink chambers, external circuit connecting electrodes provided individually for the aforesaid multiple ink chambers for connecting the aforesaid driving electrodes to an external circuit, and electrically conductive material filled in each of the aforesaid multiple ink chambers at a rear end portion of the head, wherein the aforesaid external circuit connecting electrodes are individually formed on individual exposed surface regions of the aforesaid electrically conductive material, and the area of each of the aforesaid exposed surface regions is made larger than the cross-sectional area of each of the aforesaid multiple ink chambers as measured in a groove width direction. The groove width direction means the direction perpendicular to the longitudinal direction of the ink chamber.

In this structure, the external circuit connecting electrodes for connecting the ink jet head to the external circuit each have a cross-sectional area larger than that of each of the ink chambers as measured in the groove width direction and are formed on the exposed surface regions of the electrically conductive material filled in grooves which connect to the ink chambers at the rear end portion of the head.

Accordingly, although internal electrodes of individual ink chambers have been extended to the outside of the ink chambers to allow the mounting of the ink jet head in the prior art, it becomes unnecessary to extend the electrodes outward and portions other than active areas of an actuator become almost unnecessary. As a consequence, it becomes possible to achieve a size reduction of the actuator and realize a significant reduction in materials cost.

Also, the capacitance of the ink jet head decreases due to the significant reduction of the portions other than the active areas. For this reason, driving frequency can be increased, so that it becomes possible to realize high-speed printing. In addition, since driving voltage can be reduced, it becomes possible to lower withstand voltage of a driving IC, making it possible to realize a cost reduction of the driving IC and a reduction in power consumption for driving the same.

Furthermore, since each of the external circuit connecting electrodes made of the filled electrically conductive material has a cross-sectional area larger than the cross-sectional area of each ink chamber, it is possible to establish electrical connections between the ink jet head and the external circuit electrodes with low connecting resistance through large areas in a stable fashion even if the ink jet head is a narrow-pitch ink jet head. This makes it possible to ensure excellent environmental reliability and transmit a stable driving waveform to the driving electrodes at a high frequency, so that it becomes possible to perform high-speed printing.

According to this invention, the aforesaid electrically conductive material is filled in partially deepened deep groove portions formed in the ink chambers at the rear end portion of the head. As an alternative, the aforesaid electrically conductive material may be filled in partially widened wide grooves formed at the rear end portion of the head.

BEST MODES FOR CARRYING OUT THE INVENTION

Ink jet heads, ink jet head modules and methods of manufacturing the same according to embodiments of the invention are described below in detail with reference to the drawings.

FIRST EMBODIMENT

Figure 1B:
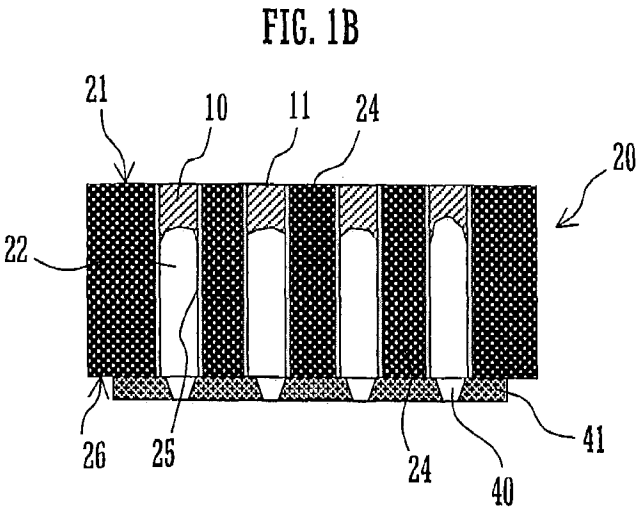
FIGS. 1A, 1B and 1C show cross-sectional diagrams of an ink jet head according to an embodiment of the present invention.
Figure 1A:
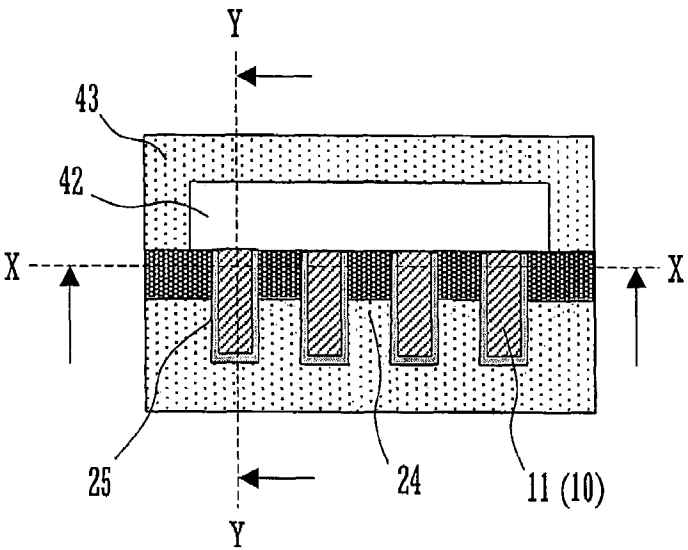
Figure 1C:
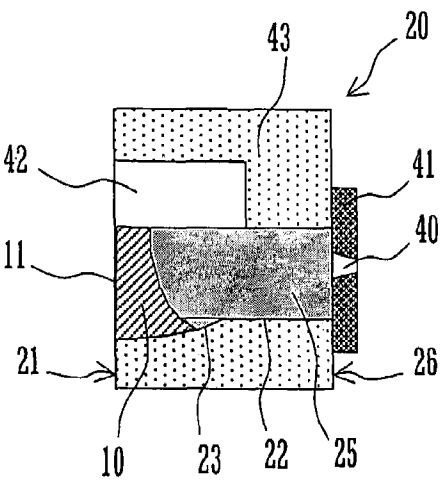

FIG. 1 shows cross-sectional diagrams of an ink jet head, in which FIG. 1A is a cross-sectional front view, FIG. 1B is a cross-sectional view taken along a line X-X, and FIG. 1C is a cross-sectional view taken along a line Y-Y. In this ink jet head, electrically conductive resin 10 containing silver-based electrically conductive filler is filled in grooves which connect to ink chambers 22 located in a rear end portion (rear end portion of the head) 21 of an actuator 20 made of piezoelectric material PZT. Regions (exposed surface regions) of the electrically conductive resin 10 exposed in an end surface by which the electrically conductive resin 10 is cut at the rear end portion 21 of the actuator 20 constitute electrically conductive resin electrodes 11 which serve as external circuit connecting electrodes.

The ink chambers 22 have a larger groove depth on a rear end side of the actuator 20 (refer to FIG. 1C). While the ink chambers 22 are 100 μm deep, the groove depth of these deep groove portions 23 is set to 110 μm at the rear end portion 21. Also, the width of each ink chamber 22 is set to 36 μm. Thus, each of the exposed surface regions of the electrically conductive resin 10 has a surface area of 3960 $\mu m^2$.

The present embodiment employs an wafer of Chevron-type piezoelectric material formed by bonding PZT substrates made of the PZT piezoelectric material of which piezoelectric properties have been oriented in opposite directions. In this embodiment, the depth of the ink chambers 22 is 100 μm and the individual ink chambers 22 are arranged in an array at intervals of 84.65 μm (which corresponds to 300 dpi), wherein an upper half (50 μm) and a lower half (50 μm) of each ink chamber 22 have opposite poling directions.

On the inside of each ink chamber 22, that is, on internal surfaces of ink chamber walls 24 separating the ink chambers 22 of the ink chamber array and on a bottom surface of the groove of each ink chamber 22, there is formed an actuator driving electrode (driving electrode of this invention) 25. The electrically conductive resin 10 and the actuator driving electrode 25 in each ink chamber 22 are electrically connected to each other.

A nozzle plate 41 having fine nozzle holes 40 is attached to an ink ejecting surface 26 of the actuator 20 and an ink supply opening 42 preformed in a cover member 43 is disposed above the rear end portion 21 of the actuator 20.

In this structure, the individual ink chambers 22 arranged in an array form are separated by the ink chamber walls 24 made of the piezoelectric material. The electrically conductive resin 10 which is connected to the actuator driving electrodes 25 formed on the individual ink chamber walls 24 constitutes electrodes for external connections which will be connected to external circuit electrodes (external circuit of this invention) in a later process.

Since the piezoelectric properties of the upper half and the lower half of each ink chamber wall 24 are oppositely oriented in a thickness direction, the walls 24 act as an actuator driven in the shear mode if reverse-phased voltages are applied to the electrodes on opposite sides of the ink chamber wall 24. Therefore, it is possible to eject fine ink droplets through the nozzle holes 40 by controlling pressure applied to the ink in each ink chamber 22.

Figure 2C:
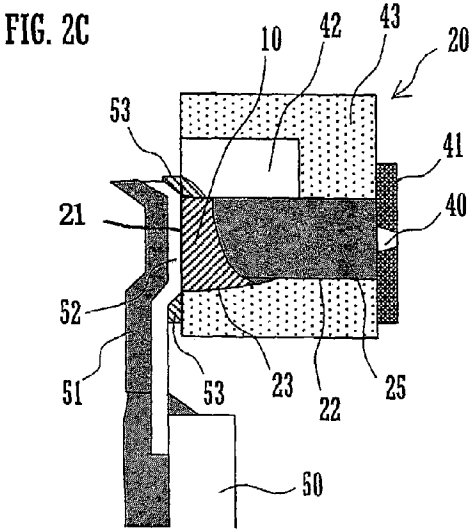
FIGS. 2A, 2B and 2C show cross-sectional diagrams of an ink jet head module connected with a driving IC according to the embodiment of the present invention shown in FIGS. 1A-1C.
Figure 2B:
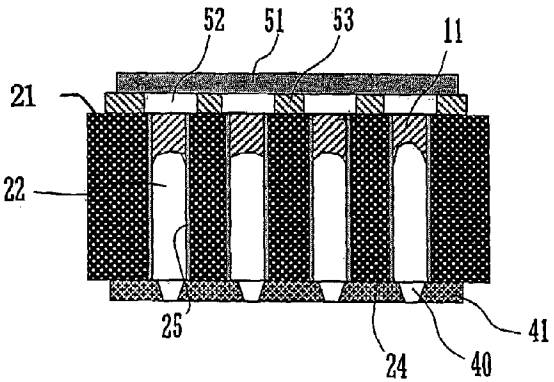
Figure 2A:
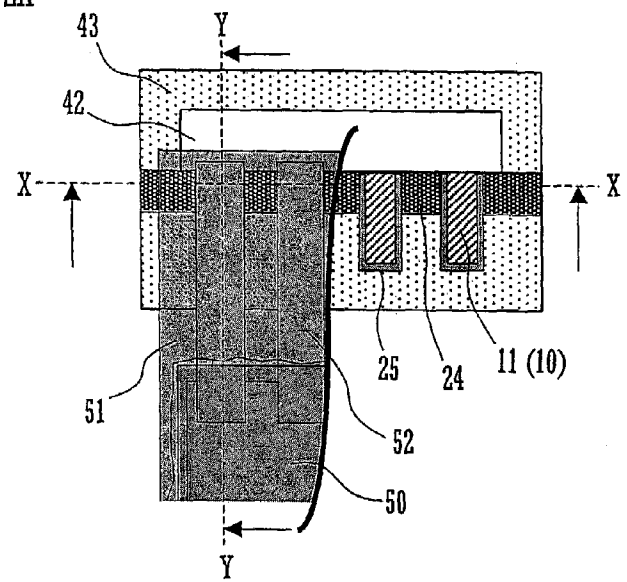

This ink jet head can be electrically and mechanically connected to outer leads 52 formed on a TAB tape 51 (see FIGS. 2A-2C), the outer leads 52 being connected to a driving IC 50, at the electrically conductive resin electrodes 11 at the rear end portion 21 of the actuator 20 via ACF (anisotropic conductive film) 53 as shown in FIGS. 1B and 2B. Although not illustrated in detail, the ACF 53 is made essentially of an epoxy resin binder which is stable in the B stage containing dispersed electrically conductive particles formed of plastic measuring 5 μm in diameter of which the surfaces are plated with nickel (Ni) and gold (Au).

The exposed surface area of each of the electrically conductive resin electrodes 11 of the ink jet head which are formed as the external circuit connecting electrodes is set to 3960 $\mu m^2$ as mentioned earlier. It is possible to ensure excellent environmental reliability, because the electrically conductive resin electrodes 11 can be electrically connected with low connecting resistance in a stable manner at low cost by using such ACF products as FP1661 or FP13413 manufactured by Sony Chemicals Corporation or AC-4073 manufactured by Hitachi Chemical Co., Ltd. which are commercially available at low prices containing ordinary quantities of dispersed electrically conductive particles as shown in Table 1. Also, it is possible to obtain an ink jet head having a high-speed printing capability since a stable driving waveform can be transmitted to the driving electrodes 25 at a high frequency.

TABLE 1

Relationship between surface area of electrically conductive resin electrode and ACF connecting resistance

| | Groove width (μm) | Groove depth (μm) | Surface area of electrically conductive resin electrode 11 ($\mu m^2$) | Connecting resistance (Ω) | Suitability |
|---|---|---|---|---|---|
| Sample A | 36 | 100 | 3600 | 0.5-500 | NG |
| Sample B | 36 | 110 | 3960 | 0.01-0.05 | OK |
| Sample C | 36 | 120 | 4320 | 0.01-0.04 | OK |
| Sample D | 36 | 150 | 5400 | 0.01-0.04 | OK |

As shown in Table 1, Sample A has a rather high value of connecting resistance (Ω) because the area of the electrically conductive resin electrode 11 is 3600 $\mu m^2$, whereas Samples B, C and D have sufficiently low values of connecting resistance (Ω) since the area of the electrically conductive resin electrode 11 is set to 3960 $\mu m^2$ or above.

Also, it has been recognized that ACF bonding between the ink jet head and the outer leads 52 on the TAB tape 51 exhibits good connecting performance since an electrical connection between the exposed surface region of each electrically conductive resin electrode 11 and each outer lead 52 serving as an external circuit electrode is established by at least 5 electrically conductive particles contained in the ACF in the bonding using the aforementioned inexpensive ACF containing the ordinary quantity of dispersed electrically conductive particles.

Taking into consideration the foregoing, it is possible to increase the number of effective electrically conductive particles per unit area in electrical connections by using an ACF manufactured with a larger number of electrically conductive particles dispersed in the ACF than in the ordinary ACF products. Even if the area of the electrically conductive resin electrode 11 is below 3960 $\mu m^2$, a stable electrical connection can be established if the number of electrically conductive particles in the ACF bonding is equal to or less than 5 as shown in Table 2, for example. Therefore, it is possible to ascertain that this approach provides an effective means for achieving a size reduction of the electrically conductive resin electrodes 11.

TABLE 2

Relationship between the number of electrically conductive particles and ACF connecting resistance

| | Surface area of electrically conductive resin electrode 11 ($\mu m^2$) | Type of ACF | Number of electrically conductive particles in ACF contributing to electrical connection (minimum value) | Connecting resistance (Ω) | Suitability |
|---|---|---|---|---|---|
| Sample A | 3600 | Ordinary product | 3 | 0.5-500 | NG |
| Sample B | 3960 | Ordinary product | 5 | 0.01-0.05 | OK |
| Sample C | 4320 | Ordinary product | 5 | 0.01-0.04 | OK |
| Sample D | 5400 | Ordinary product | 7 | 0.01-0.04 | OK |
| Sample E | 3600 | Product with high-density electrically conductive particles | 6 | 0.01-0.05 | OK |
| Sample F | 3960 | Product with high-density electrically conductive particles | 10 | 0.01-0.04 | OK |

Referring to Table 2, it is possible to ascertain that, although the area of the electrically conductive resin electrode 11 is 3600 $\mu m^2$, Sample E has a sufficiently low value of connecting resistance (Ω) since the number of electrically conductive particles is set to 6. This approach however has a problem that it leads to a cost increase of the ink jet head due to a cost increase of the ACF. Nevertheless, because even higher reliability is required particularly in high-end models, it would be a good practice to establish electrical connections in a reliable fashion with 5 or more electrically conductive particles at each electrode connection of a narrow-pitch ink jet head by using an expensive ACF product in which a larger number of electrically conductive particles than in the ordinary products are dispersed.

The foregoing discussion indicates that, in order to realize a low-cost head, the electrically conductive resin electrodes 11 must be designed such that each electrically conductive resin electrode 11 has an area of 3960 $\mu m^2$ or above to meet a condition for obtaining connecting stability with inexpensive ACF. In order to realize a narrower-pitch ink jet head with the highest priority placed on reliability rather than on cost, it is necessary to select expensive ACF containing electrically conductive particles dispersed at a high density and design the areas of the electrodes such that 5 or more electrically conductive particles contributory to electrical connections are secured for each electrode.

In this embodiment, the area of each external circuit electrode 52 effective for connection is larger than the area of each electrically conductive resin electrode 11 of the ink jet head. In other words, by connecting the electrically conductive resin electrodes 11 and the external circuit electrodes 52 with the electrode lead width of each external circuit electrode 52 set larger than the interval (groove width) of the adjacent electrically conductive resin electrodes 11, and by connecting the electrically conductive resin electrodes 11 and the external circuit electrodes 52 such that, when a lead of each external circuit electrode 52 is connected parallel to the corresponding electrically conductive resin electrode 11 along a groove depth direction of the electrically conductive resin electrode 11, an entire region of the electrically conductive resin electrode 11 from a groove bottom to groove top thereof overlaps the external circuit electrode 52, positioning accuracy required in ACF bonding process is made less stringent. Consequently, manufacturing yield is improved and electrical connections can be established with low connecting resistance in a stable manner. This makes it possible to ensure excellent environmental reliability and transmit a stable driving waveform to the driving electrodes 25 at a high frequency. As a result, it becomes possible to realize an ink jet head having the high-speed printing capability.

Figure 3A:
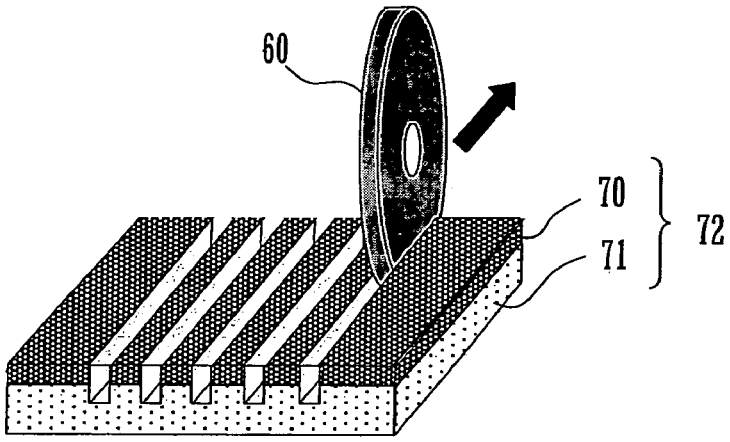
FIGS. 3A and 3B show explanatory diagrams illustrating a method of manufacturing the ink jet head according to the embodiment of the present invention shown in FIGS. 1A-1C.

Next, a method of manufacturing the ink jet head is explained with reference to FIG. 3. First, a Chevron-type piezoelectric material wafer 72 formed by bonding 50 μm-thick piezoelectric material substrates 70 and 71 of which piezoelectric properties have been oriented in opposite directions is diced to a depth of about half the thickness of the piezoelectric material wafer 72 to form grooves which will later become the ink chambers 22 by using a dicing blade 60 of a dicer as shown in FIG. 3A.

Figure 3B:
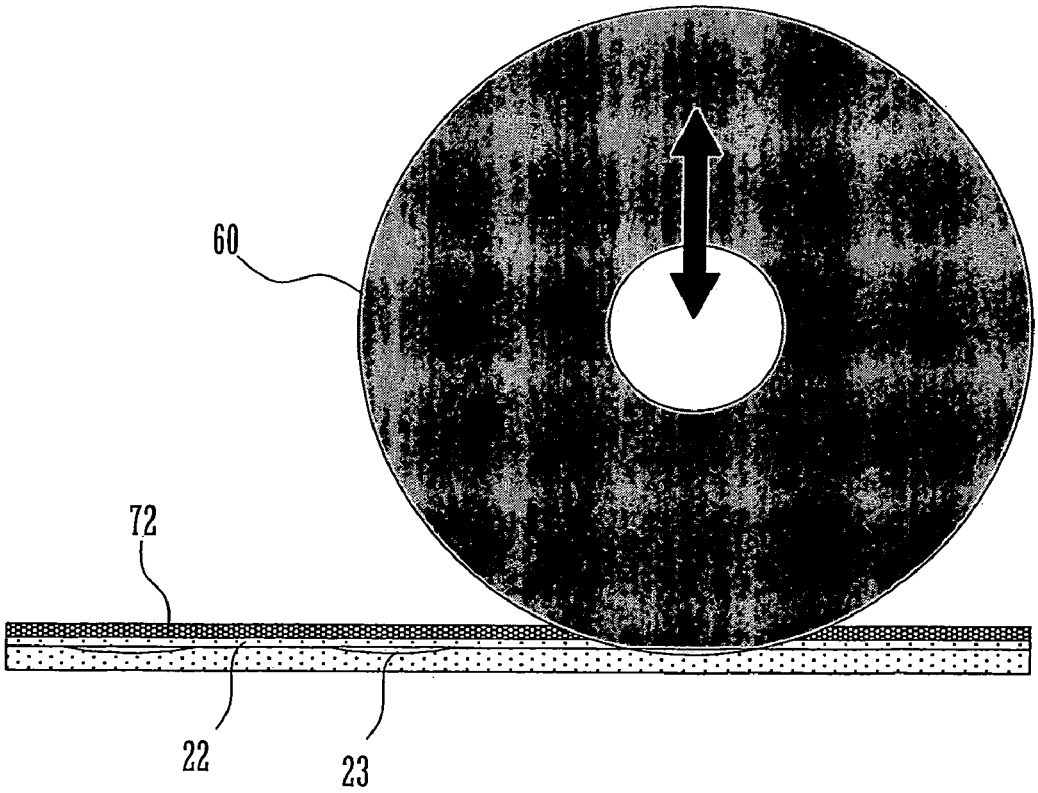

Next, the blade is lowered vertically from above each groove to perform chopper grinding operation by using the same dicing blade 60 for further deepening a portion of each groove into which the electrically conductive resin 10 will later be supplied by as much as 10 μm as shown in FIG. 3B. Here, the deep groove portion 23 may be formed at the same time as each ink chamber is formed in a series of operations.

Figure 4A:
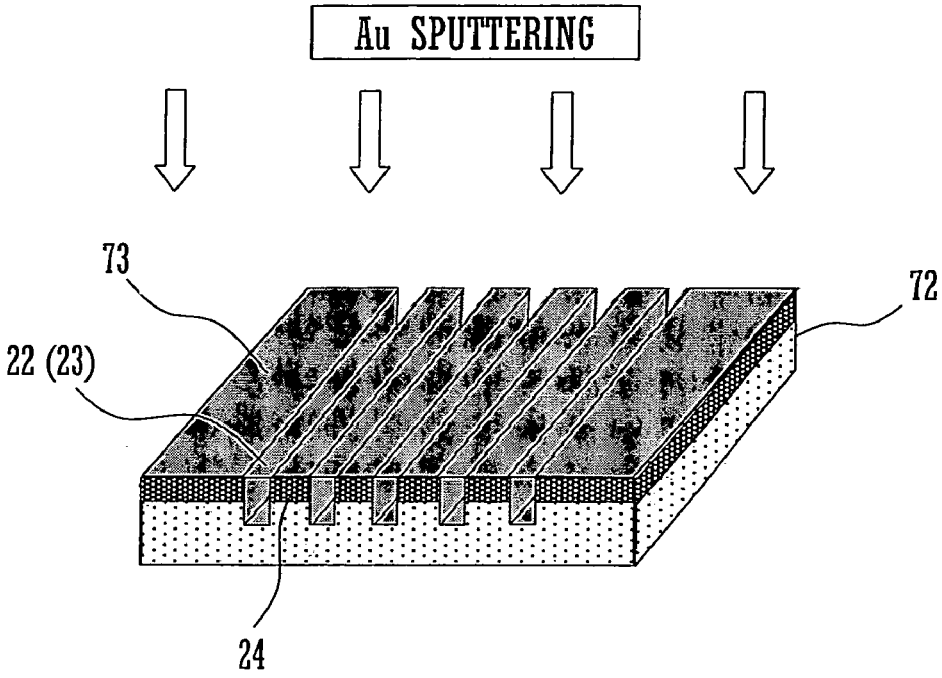
FIGS. 4A and 4B show explanatory diagrams illustrating further steps of the method of FIGS. 3A-3B.
Figure 4B:
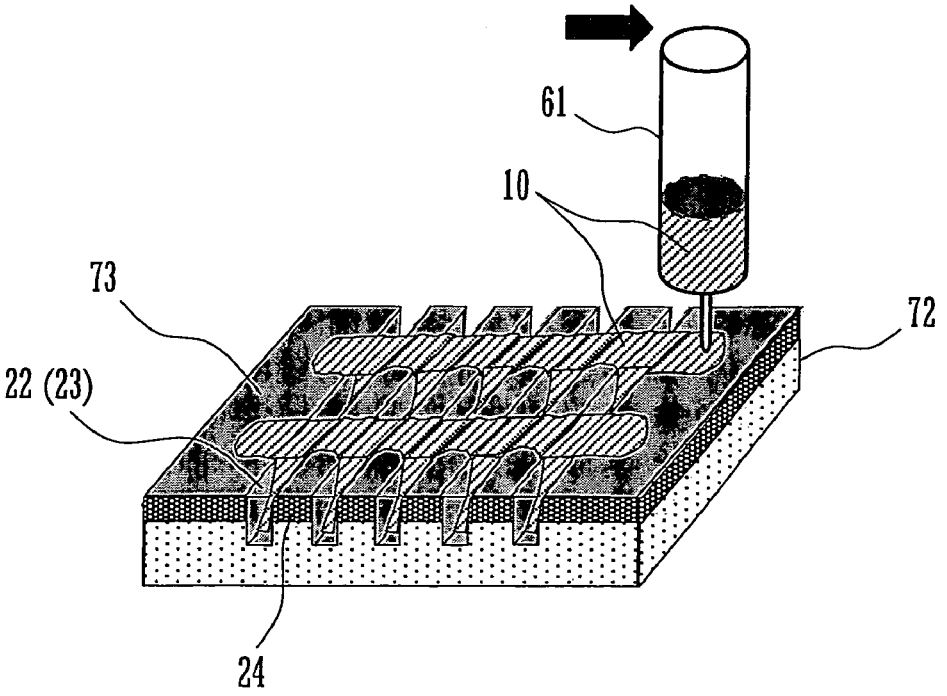

Further, a metal film 73 which can serve as electrode material, such as Au, Ni, Al or Cu, is formed on entire inside surfaces of the ink chambers by using sputtering technology as shown in FIG. 4A. Then, liquid electrically conductive resin 10 is applied to the top of the ink chambers 22 and the ink chamber walls 24 in straight lines with a width of 0.5 mm in a direction perpendicular to the array of the ink chambers 22 on the piezoelectric material wafer 72 by using a dispenser 61 as shown in FIG. 4B. Here, the viscosity of the liquid electrically conductive resin 10 is regulated to fall within a range of 500 to 1500 cps, so that the liquid electrically conductive resin 10 would naturally be filled into each ink chamber 22 down to the bottom thereof.

Even if electrically conductive resin having a relatively high viscosity is used, it is possible to naturally fill the electrically conductive resin 10 down to the bottom of the ink chambers 22. This is accomplished by leaving the piezoelectric material wafer 72 on a hot plate which is adjusted to an appropriate temperature at which hardening reaction of the electrically conductive resin will not proceed so much after dispensing, so that the viscosity of the electrically conductive resin 10 will decrease.

The electrically conductive resin 10 is then hardened by subsequent heating. Here, electrically conductive resin containing as a binder a resin of which reaction proceeds at room temperature without any heat-hardening treatment can be hardened even if left at room temperature.

Figure 5A:
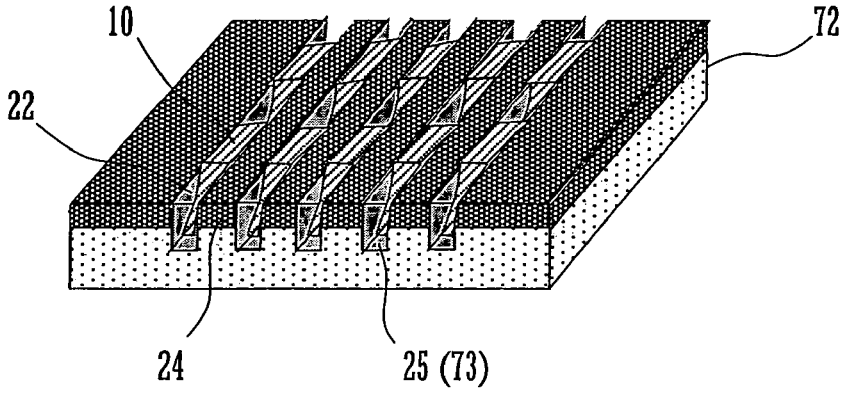
FIGS. 5A and 5B show explanatory diagrams illustrating further steps of the method of FIGS. 3A-3B.

Then, the driving electrodes 25 and the filled electrically conductive resin 10 are electrically separated for the individual ink chambers 22 as shown in FIG. 5A by grinding the metal film 73 and the electrically conductive resin 10 which currently form a short circuit conducting all across the ink chamber walls 24 by use of an unillustrated lapping film, for instance.

Next, a cover wafer 74 made of piezoelectric material in which spot faced holes for making ink supply openings 42 are formed is prepared. When ink jet heads are structured later, the cover wafer 74 forms the ink supply opening 42 of each ink jet head and constitutes the cover member 43 for sealing the top of the ink chambers 22.

Although it is common practice to use the same material as the piezoelectric material used for structuring the ink chambers 22 for producing the cover wafer 74 to ensure good matching of the thermal expansion coefficient between the cover wafer 74 and the actuator in which the ink chambers 22 are formed, inexpensive alumina ceramics of which thermal expansion coefficient is relatively close to that of the actuator may be used as an alternative.

Then, the ink chamber wafer 72 in which the array of the ink chambers 22 has been formed and the cover wafer 74 are bonded with a commercially available adhesive. At this time, the ink chamber wafer 72 and the cover wafer 74 are bonded as shown in a cross-sectional view of FIG. 5B upon aligning the positions of both in such a way that each portion where the electrically conductive resin 10 is filled matches a central portion of a corresponding spot faced area for producing the ink supply opening 42 in the cover wafer 74.

Figure 5B:
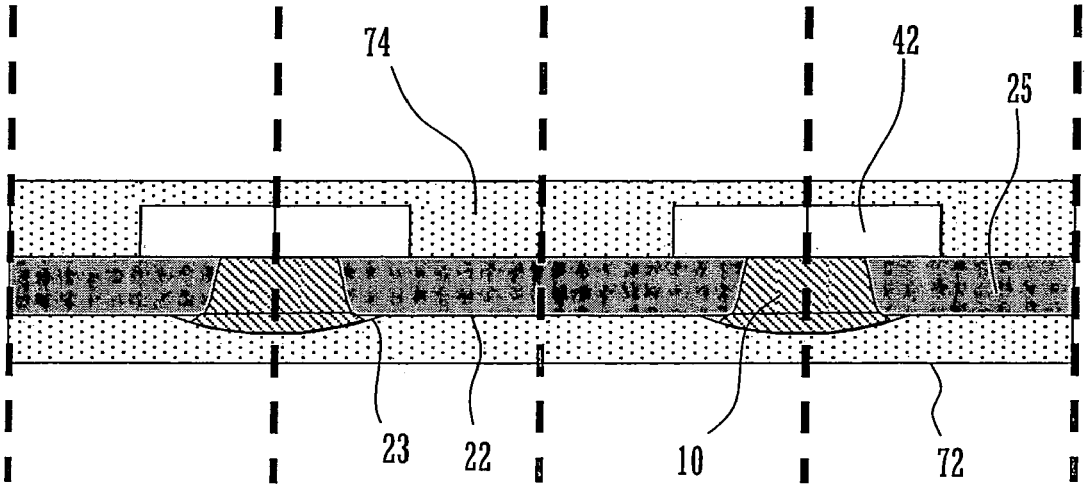

Subsequently, an assembly of the ink chamber wafer 72 and the cover wafer 74 which have been bonded together is divided into small segments to produce individual actuators (ink jet heads) by cutting the assembly at the portions where the electrically conductive resin 10 is filled in the ink chamber wafer 72 and at the spot faced areas of the cover wafer 74 for producing the ink supply openings 42 along dicing lines shown by broken lines in FIG. 5B by means of an unillustrated dicing blade of a dicer.

On a cut surface of each of the actuators thus cut, there are exposed cut areas of the electrically conductive resin 10 on one side surface of the actuator. These cut areas of the electrically conductive resin 10 constitute electrodes for establishing electrical connections with external circuit electrodes which conduct to a later connected driving IC, or the external circuit connecting electrodes 11. On the other side surface of the actuator where the electrically conductive resin 10 is not exposed, an upper surface of the ink chambers 22 is sealed by the cover member 43, constituting an actuating area for controlling pressure in each ink chamber. The nozzle plate 41 is attached to this side surface, whereby the actuator (ink jet head or ink jet head module) previously shown in FIG. 1 or 2 is completed.

In the structure of the present embodiment, each of the external circuit connecting electrodes 11 has a cross-sectional area larger than that of each ink chamber 22 as measured along the direction perpendicular to the ink chamber array. These external circuit connecting electrodes 11 are formed on the exposed surface regions of the electrically conductive resin 10 filled in the grooves which connect to the individual ink chambers 22 at the rear end portion 21 of the ink jet head.

Accordingly, while internal electrodes of individual ink chambers have conventionally been extended to the outside of the ink chambers when mounting the ink jet head, it becomes unnecessary to extend the electrodes outward and portions other than active areas of the actuator become almost unnecessary. As a consequence, it becomes possible to realize a significant reduction in materials cost.

Since the capacitance is reduced, driving frequency can be increased and, therefore, it becomes possible to perform high-speed printing. Also, since driving voltage can be decreased, it becomes possible to lower withstand voltage of the driving IC, making it possible to achieve a cost reduction of the driving IC and a reduction in power consumption for driving the same.

Since each of the external circuit connecting electrodes 11 formed at the cut areas of the filled electrically conductive resin 10 has a cross-sectional area larger than the cross-sectional area of each ink chamber, it is possible to establish electrical connections between the ink jet head and the external circuit electrodes 52 with low connecting resistance through large areas in a stable fashion even if the ink jet head is a narrow-pitch ink jet head. The ink jet head thus structured has excellent environmental reliability and this makes it possible to transmit a stable driving waveform to the ink jet head at a high frequency, so that it becomes possible to perform high-speed printing.

Furthermore, the electrodes 11 for connections to the external circuit which are connected to the external circuit electrodes 52 can ensure that each of connecting surface regions of the electrically conductive resin 10 has an exposed surface area of 3960 $\mu m^2$ or above. Thus, the ink jet head has sufficient electrode areas for providing electrical connections to the external circuit electrodes 52 even when the inexpensive ACF containing a relatively small quantity of dispersed electrically conductive particles is used for the connections. It is therefore possible to connect the ink jet head to the external circuit in a stable manner with low connecting resistance and small variations in the connecting resistance. This makes it possible to ensure excellent environmental reliability and transmit a stable driving waveform to the driving electrodes 25 at a high frequency, so that it becomes possible to perform high-speed printing.

On the other hand, in the ink jet head module which is a combined unit formed by connecting the ink jet head to the external circuit electrodes 52 connected to the driving IC 50, the exposed surface regions of the electrically conductive material, that is, the external circuit connecting electrodes 11 of the ink jet head, are electrically connected to the external circuit electrodes 52 via anisotropic conductive material by means of at least 5 electrically conductive particles contained in the anisotropic conductive material at each electrode 11 for the connection between the ink jet head and the external circuit electrodes 52.

Accordingly, there exist sufficient quantities of electrically conductive particles contained in the anisotropic conductive material in the electrical connections between the ink jet head and the external circuit electrodes 52 and, therefore, it is possible to connect the ink jet head to the external circuit in a stable manner with low connecting resistance and small variations in the connecting resistance. This makes it possible to ensure excellent environmental reliability and transmit a stable driving waveform to the driving electrodes 25 at a high frequency, so that it becomes possible to perform high-speed printing.

Also, the area of a connecting part of each of the external circuit electrodes 52 of the ink jet head module is larger than the area of each of the external circuit connecting electrodes 11 of the ink jet head. Accordingly, a large margin for positioning error can be secured in making electrical connections and the required positioning accuracy is made less stringent, so that it is possible to use the entirety of the external circuit connecting electrodes of the ink jet head for establishing the electrical connections in a stable fashion. Thus, it is possible to realize an improvement in productivity and make stable connections to the external circuit with low connecting resistance and small variations in the connecting resistance. This makes it possible to ensure excellent environmental reliability and transmit a stable driving waveform to the driving electrodes 25 at a high frequency, so that it becomes possible to perform high-speed printing.

If the shape of area of each external circuit connecting electrode 11 of the ink jet head are same as those of each external circuit electrode 52 in the electrical connections between the ink jet head and the external circuit electrodes 52, high accuracy is required for positioning when connecting the external circuit connecting electrodes 11 of the ink jet head and the external circuit electrodes 52, resulting in a reduction in manufacturing yield.

The aforementioned ink jet head can be produced by a manufacturing method including at least the following processes. Specifically, the ink jet head can be produced by a manufacturing procedure including a process of forming ink chamber grooves at specific intervals in a piezoelectric material wafer of which piezoelectric properties have been oriented along a thickness direction, a process of forming grooves having a larger depth than the ink chamber grooves and connected to the aforementioned ink chamber grooves, a process of forming driving electrodes on the inside of the aforementioned ink chamber grooves and the aforementioned grooves deeper than the ink chamber grooves, a process of filling electrically conductive material in the aforementioned ink chamber grooves and the aforementioned grooves deeper than the ink chamber grooves in such a manner that the electrically conductive material connects to the electrodes on the inside of the aforementioned ink chamber grooves, a process of curing the aforementioned electrically conductive material, a process of bonding the aforementioned piezoelectric material wafer and a cover wafer, and a process of dividing the aforementioned bonded piezoelectric material wafer into small segments.

In the ink jet head produced by the aforementioned manufacturing method, each of the external circuit connecting electrodes 11 made of the filled electrically conductive material has a cross-sectional area larger than that of each ink chamber as previously discussed and, therefore, the external circuit connecting electrodes 11 can be electrically connected to the external circuit electrodes 52 in a stable fashion at a later time. Specifically, because electrical connections to the external circuit electrodes 52 are established by the connecting electrodes having large areas, it is possible to connect them with low connecting resistance in a stable fashion even if the ink jet head is a narrow-pitch ink jet head. This makes it possible to ensure excellent environmental reliability and transmit a stable driving waveform to the ink jet head at a high frequency, so that it becomes possible to perform high-speed printing.

Figure 6C:
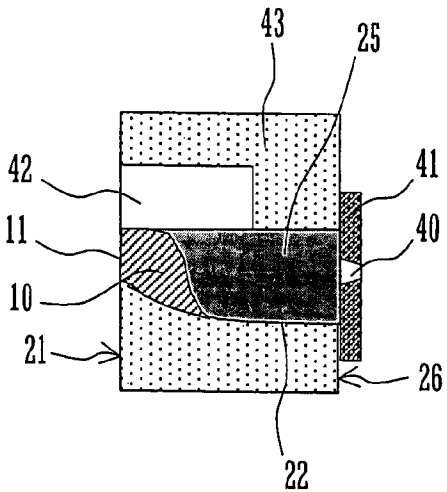
FIGS. 6A, 6B and 6C show cross-sectional diagrams of an ink jet head according to a different embodiment of the invention.
Figure 6B:
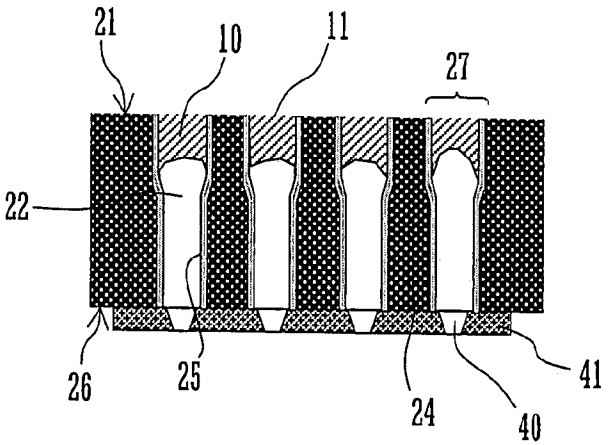
Figure 6A:
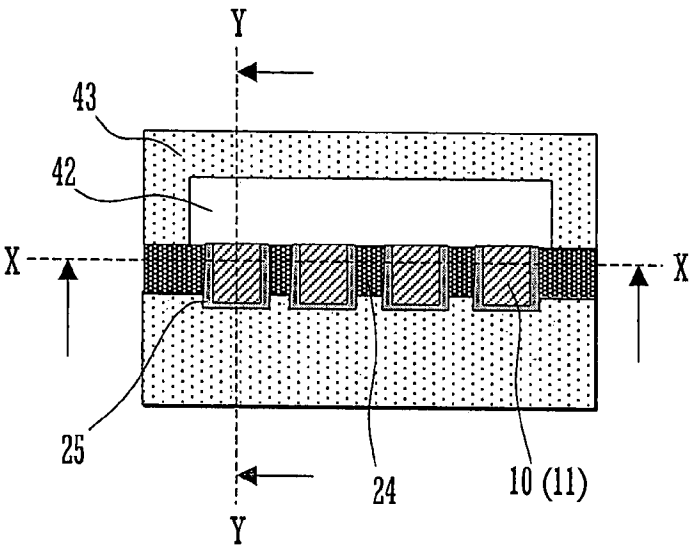
Figure 7C:
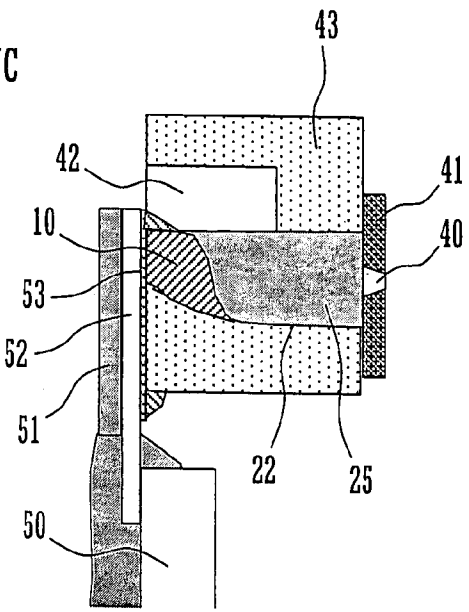
FIGS. 7A, 7B and 7C show cross-sectional diagrams of an ink jet head module connected with a driving IC according to the embodiment of FIGS. 6A-6B.
Figure 7B:
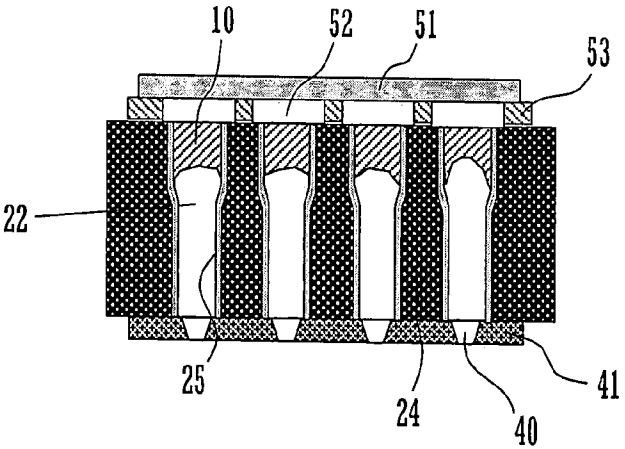
Figure 7A:
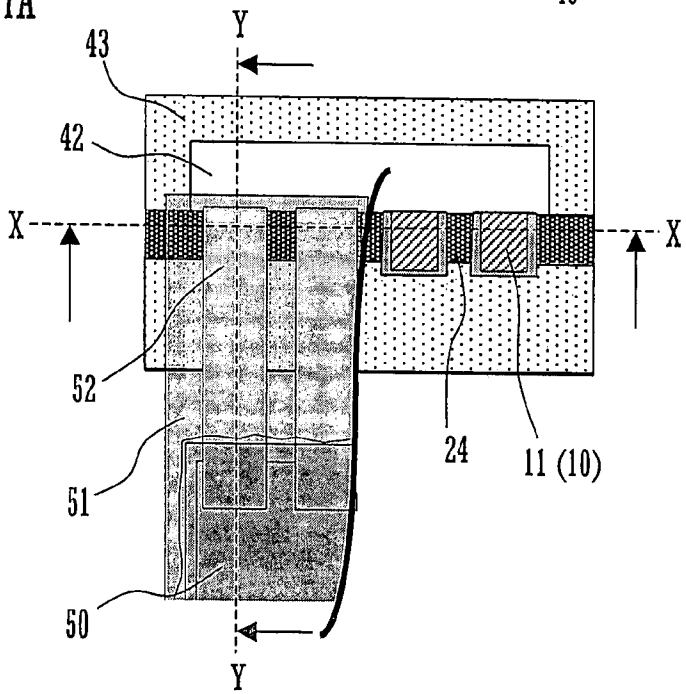

While the areas of the electrically conductive resin electrodes 11 later exposed on the cut surface of each segmented ink jet head are increased by filling the electrically conductive resin 10 into the grooves deeper than the ink chambers 22, the same effect is expected to be achieved by forming wide grooves 27 of which groove width is made larger than that of the ink chambers 22 as shown in FIGS. 6A-6C). The depth of the ink chambers 22 shown in FIG. 6C is 100 μm and each of the electrically conductive resin electrodes 11 is machined to a cross-sectional shape measuring 90 μm deep, in which the surface area of each electrically conductive resin electrode 11 is set to 3960 $\mu m^2$ which is larger than the area of each ink chamber 22. Therefore, it is possible to realize stable external circuit connections to external circuit leads 52 connected to driving IC 50 at low cost by using the inexpensive ACF 53. (See, FIGS. 7A-7C) Also, the groove width is so large that the electrically conductive resin 10 can be filled with ease and an improvement in manufacturing yield can be realized in the process of filling the electrically conductive resin 10.

The aforementioned ink jet head can be produced by a manufacturing method including at least the following processes. Specifically, the ink jet head can be produced by a manufacturing procedure including a process of forming ink chamber grooves at specific intervals in a piezoelectric material wafer of which piezoelectric properties have been oriented along a thickness direction, a process of forming grooves having a larger width than the ink chamber grooves and connected to the aforementioned ink chamber grooves, a process of forming driving electrodes on the inside of the aforementioned ink chamber grooves and the aforementioned grooves wider than the ink chamber grooves, a process of filling electrically conductive material in the aforementioned ink chamber grooves and the aforementioned grooves wider than the ink chamber grooves in such a manner that the electrically conductive material connects to the electrodes on the inside of the aforementioned ink chamber grooves, a process of curing the aforementioned electrically conductive material, a process of bonding the aforementioned piezoelectric material wafer and a cover wafer, and a process of dividing the aforementioned bonded piezoelectric material wafer into small segments.

In the ink jet head produced by the aforementioned manufacturing procedure, each of the external circuit connecting electrodes 11 made of the filled electrically conductive material has a cross-sectional area larger than that of each ink chamber 22 and, therefore, the external circuit connecting electrodes 11 can be electrically connected to the external circuit electrodes 52 in a stable fashion at a later time. Specifically, because electrical connections to the external circuit electrodes 52 are established by the connecting electrodes having large areas, it is possible to connect them with low connecting resistance in a stable fashion even if the ink jet head is a narrow-pitch ink jet head. The ink jet head thus structured has excellent environmental reliability and this makes it possible to transmit a stable driving waveform to the ink jet head at a high frequency, so that it becomes possible to perform high-speed printing.

SECOND EMBODIMENT

Now, another embodiment of the present embodiment is described with reference to the drawings.

Figure 8:
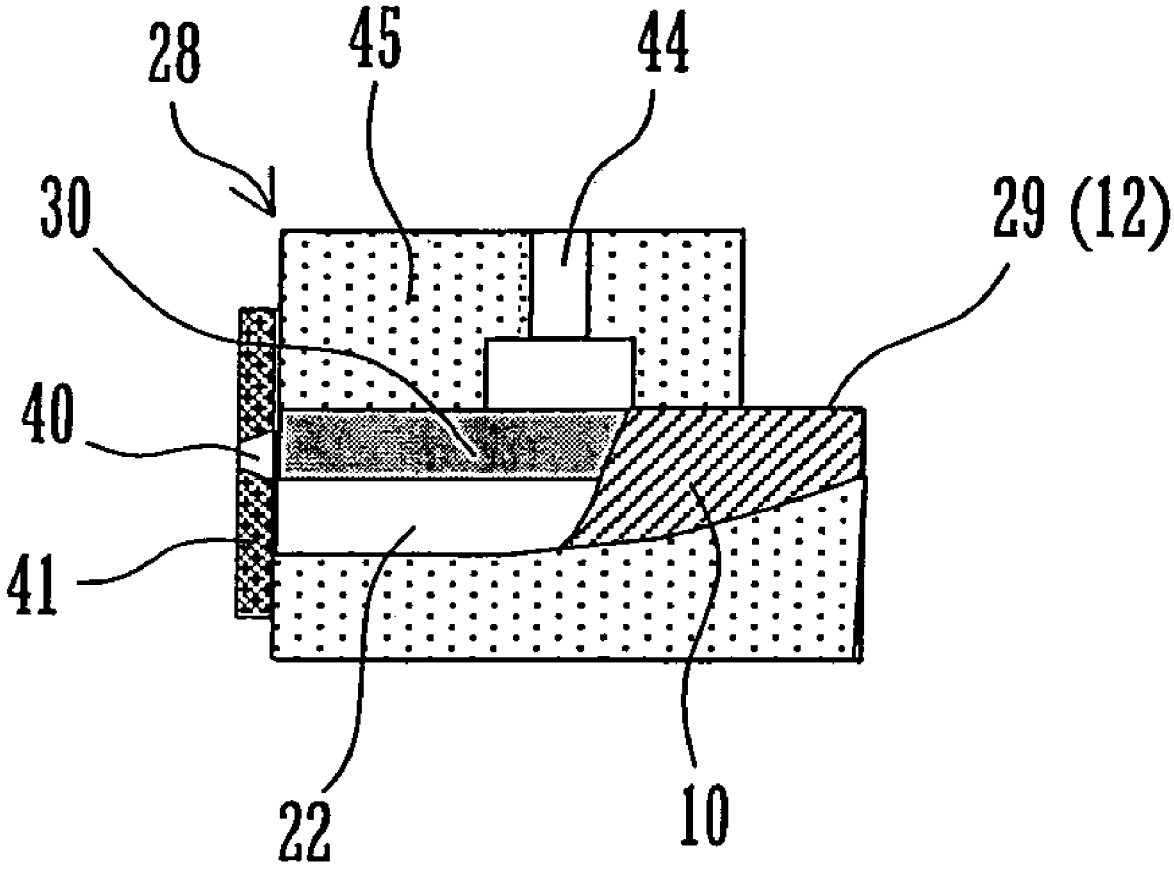
FIG. 8 is a cross-sectional diagram of an ink jet head according to another embodiment of the invention.

FIG. 8 is a cross-sectional view of an ink jet head. In this ink jet head, electrically conductive resin 10 containing silver-based electrically conductive filler is filled in a rear end portion of an actuator 28 and regions of the electrically conductive resin 10 exposed at an upper surface of the electrically conductive resin 10 filled in the rear end portion of the actuator 28 are used as external circuit connecting electrodes 12.

Ink chambers 22 are made shallower in groove depth on a rear end side of the actuator 28. This structure makes it possible to decrease unwanted capacitance since the structure helps reduce areas of electrodes on both sides of each of ink chamber walls compared to a structure of uniformly deep ink chambers. This structure serves to reduce power consumption for driving the actuator 28 and prevent driving waveform from becoming unsharp more effectively. In addition, since ink is fed through an ink supply opening 44 in a cover wafer located close to the rear end portion of the actuator, it is possible to smoothen ink flow.

While the depth of each ink chamber 22 is 100 μm, the groove depth at the rear end portion where the electrically conductive resin 10 is filled is set to 50 μm, and the width of each ink chamber 22 is set to 36 μm. Each of exposed surface regions of the electrically conductive resin 10 at filled upper parts 29 of the electrically conductive resin 10 measures 36 μm wide by 600 μm long. As a connecting area of 3960 $\mu m^2$ or above can be secured in a later connection with an external circuit if the length of each exposed surface region is equal to 110 μm or above, it is possible to establish stable electrical connections at low cost.

A pair of actuator driving electrodes 30 is formed in each of the ink chambers 22, the actuator driving electrodes 30 facing each other in the ink chamber 22. These two actuator driving electrodes 30 are connected to each other in each ink chamber 22 via the filled electrically conductive resin 10. A nozzle plate 41 having fine nozzle holes 40 is attached to an ink ejecting surface of the actuator 28 and the ink supply opening 44 preformed in a cover member 45 is disposed above the rear end portion of the actuator 28.

In this structure, the individual ink chambers 22 arranged in an array form are separated by the ink chamber walls made of piezoelectric material. The electrodes are located on an upper half of each wall. (Since shallow grooves measuring 50 μm deep are formed close to the rear end portion of the actuator, the electrodes are formed on the entire wall surfaces down to a groove bottom.) Voltages are applied to the electrically conductive resin electrodes 12 exposed at the upper surfaces 29 in the rear end portion of the actuator, the electrically conductive resin electrodes 12 made of the electrically conductive resin 10 being concentrated as a group of electrodes for external connections. As reverse-phased voltages are applied to the electrodes on opposite sides an ink chamber wall 32, each ink chamber 22 is actuated in the shear mode such that the wall 32 bends at a joint surface forming the electrode in the ink chamber. As a result, a function as an actuator is produced, making it possible to eject fine ink droplets through the nozzle holes 40.

Figure 9:
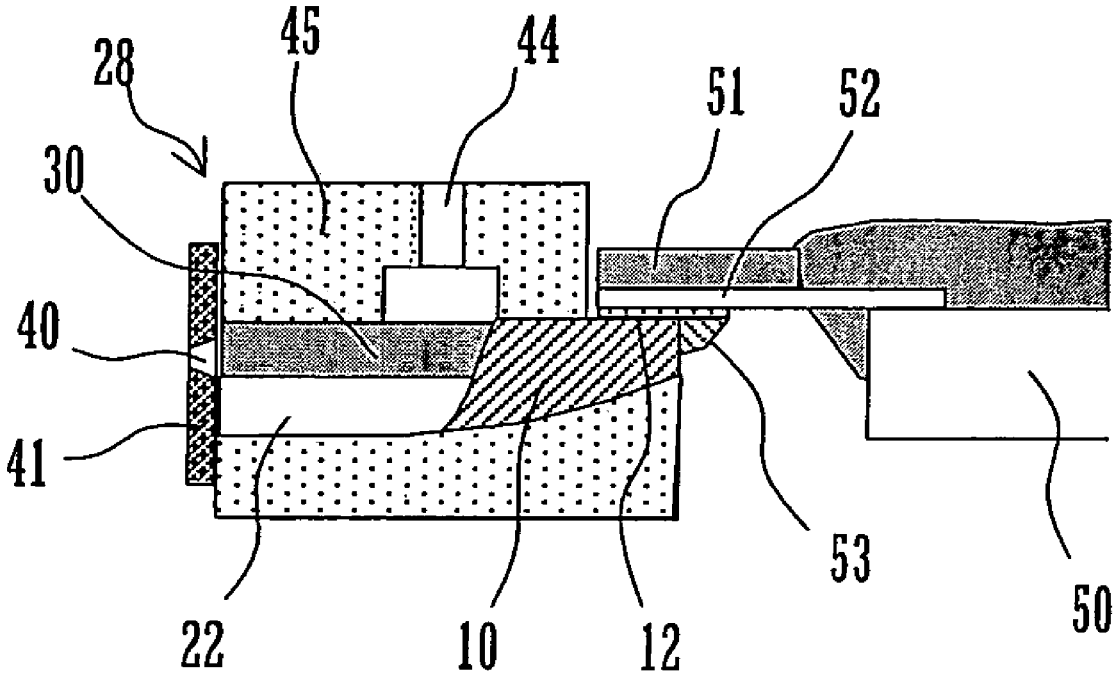
FIG. 9 is a cross-sectional diagram of an ink jet head module connected with a driving IC according to the embodiment of the invention of FIG. 8.

The ink jet head of this embodiment can be used for producing an ink jet head module by electrically and mechanically connecting outer leads 52 formed on a TAB tape 51, the outer leads 52 being connected to a driving IC 50, and the electrically conductive resin electrodes 12 on the upper surface of the rear end portion of actuator 28 via ACF 53, for instance, as shown in FIG. 9.

Figure 10A:
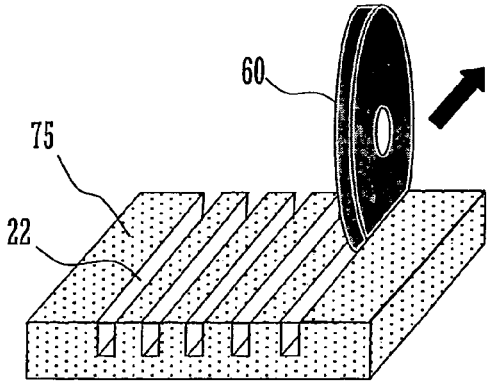
FIGS. 10A and 10B show explanatory diagrams illustrating a method of manufacturing the ink jet head according to the embodiment of the invention of FIG. 8.
Figure 10B:
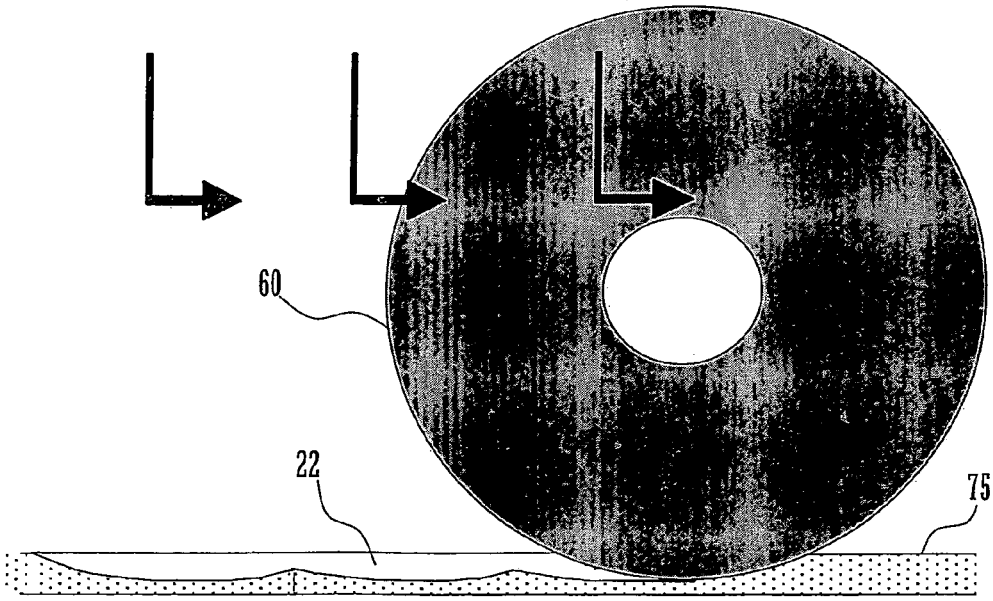

Next, a method of manufacturing the aforementioned ink jet head is explained with reference to FIG. 10. First, grooves measuring 36 μm wide which will later become the ink chambers 22 are formed in a piezoelectric material wafer 75 by using a dicing blade 60 of a dicer as shown in FIG. 10A. As portions where the electrically conductive resin 10 will later be filled are made shallower than the ink chamber portions 22 as shown in FIG. 10B, ease of filling the electrically conductive resin 10 is enhanced. This makes it possible to facilitate control of production and realize an improvement in manufacturing yield.

Figure 11A:
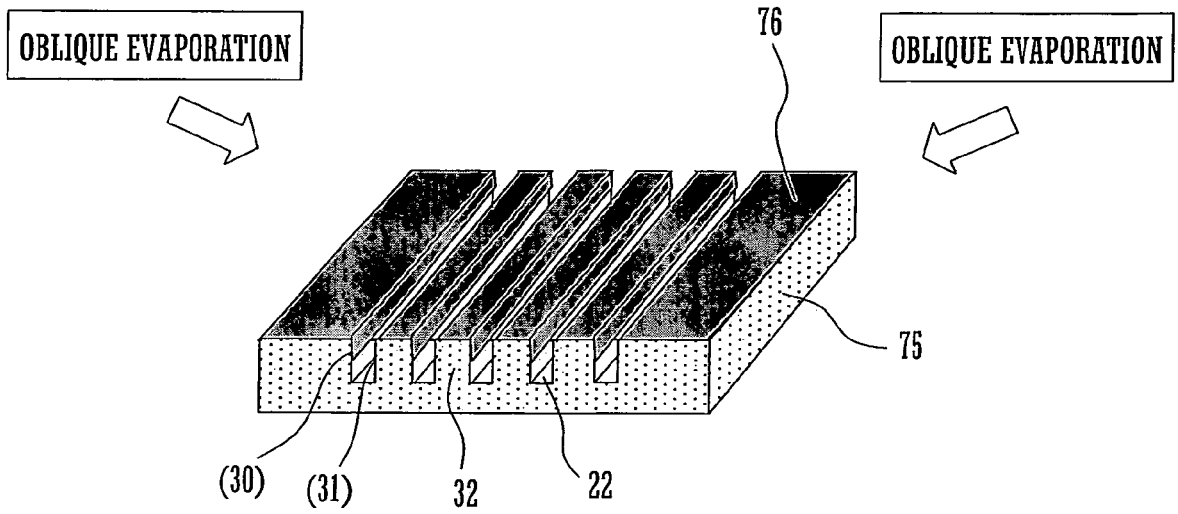
FIGS. 11A and 11B show explanatory diagrams further illustrating the method of FIGS. 10A-10B.

After an ink chamber array has been thus formed, metal which can serve as electrode material, such as Al or Cu, is obliquely evaporated from directions perpendicular to a longitudinal direction of the ink chambers 22 at oblique angles from above as shown in FIG. 11A. Metal electrodes 76 are formed on surfaces of the ink chamber walls 32 by performing this operation from two directions (left and right) with respect to the longitudinal direction of the ink chambers 22. Due to a shadowing effect of the individual ink chamber walls 32, a metal film 76 is formed to about one-half of the depth of the ink chambers 22, and in a region of the shallow grooves where the electrically conductive resin 10 will later be filled, the electrodes are formed generally down to the groove bottom. Here, the electrodes 30 and 31 facing each other in each of the ink chambers 22 constitute driving electrodes.

Figure 11B:
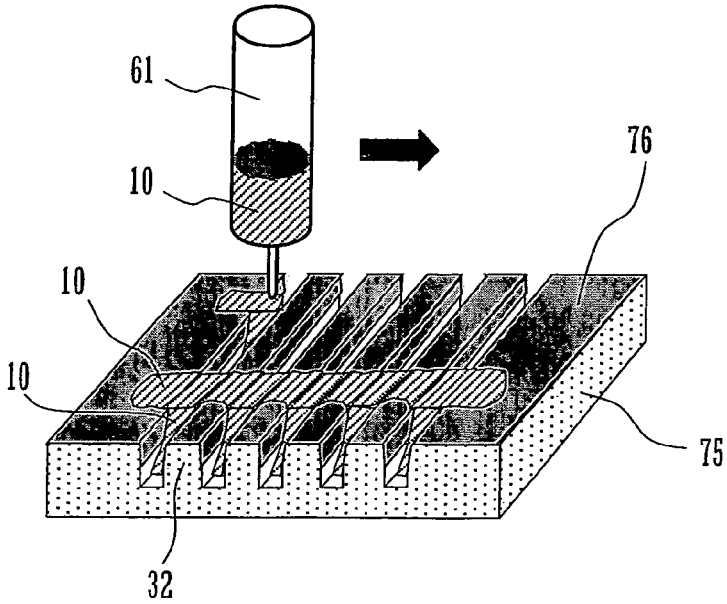

Next, liquid electrically conductive resin is applied to the top of the ink chambers 22 and the ink chamber walls 32 in straight lines with a width of 2.0 mm in a direction perpendicular to the array of the ink chambers 22 on the piezoelectric material wafer 75 by using a dispenser 61 as shown in FIG. 11B. Subsequently, the electrically conductive resin 10 is hardened.

Figure 12A:
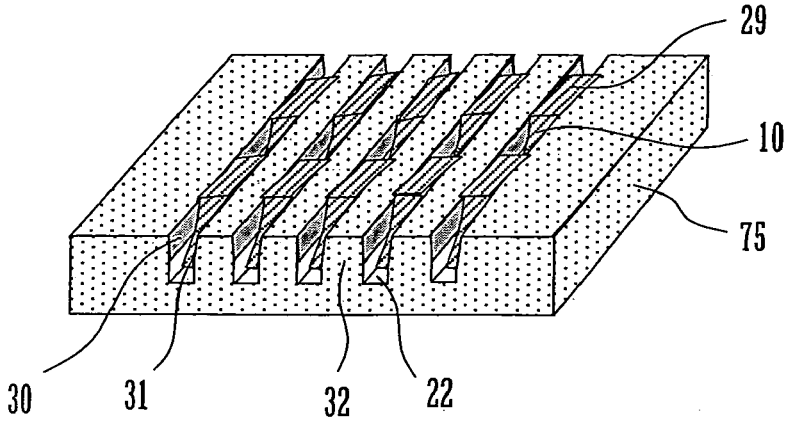
FIGS. 12A and 12B show explanatory diagrams further illustrating the method of FIGS. 10A-10B.

Next, as the obliquely evaporated metal film 76 and the electrically conductive resin 10 currently form a short circuit conducting all across the ink chamber walls 32, portions of the metal film 76 and the electrically conductive resin 10 covering the top of the ink chamber walls 32 are removed by grinding operation as shown in FIG. 12A by use of an unillustrated end mill, for example.

Next, a cover wafer 79 made of piezoelectric material, in which through holes 77 for making ink supply openings 44 and spot faced clearance parts 78 for ensuring that the cover wafer 79 will not cover the entirety of the filled upper surfaces 29 of the electrically conductive resin 10 which will later become the electrically conductive resin electrodes 12 are formed, is prepared. When divided into small segments for individual ink jet heads at a later time, this cover wafer 79 constitutes the cover member of each ink jet head for covering the top of the ink chambers 22 and sealing the rear end of the ink chambers 22 excluding the electrically conductive resin electrodes 12 located at the rear end portion of the actuator.

Figure 12B:
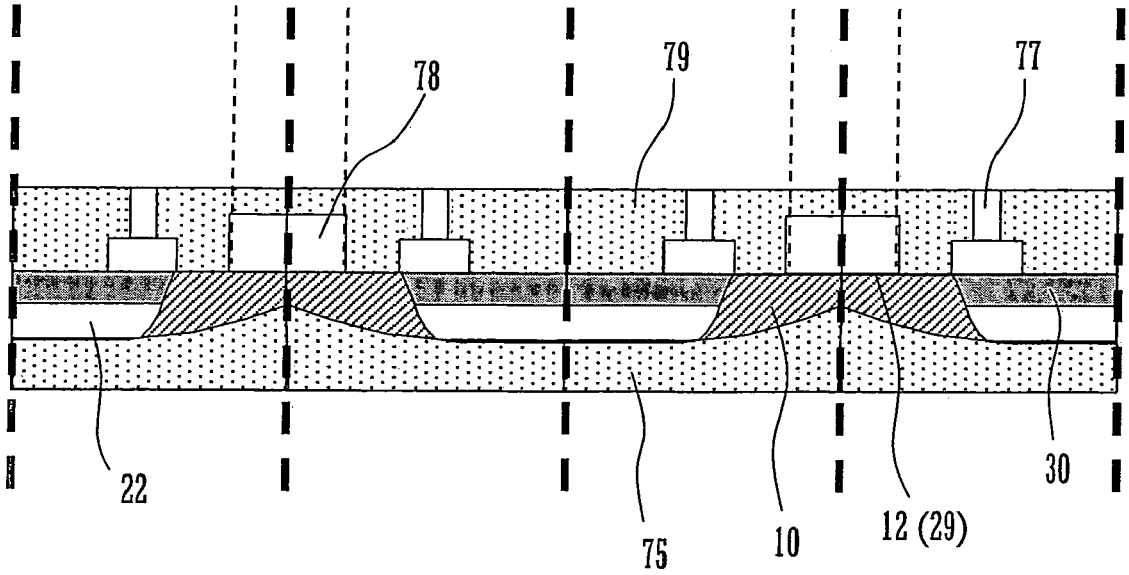
Figure 13:
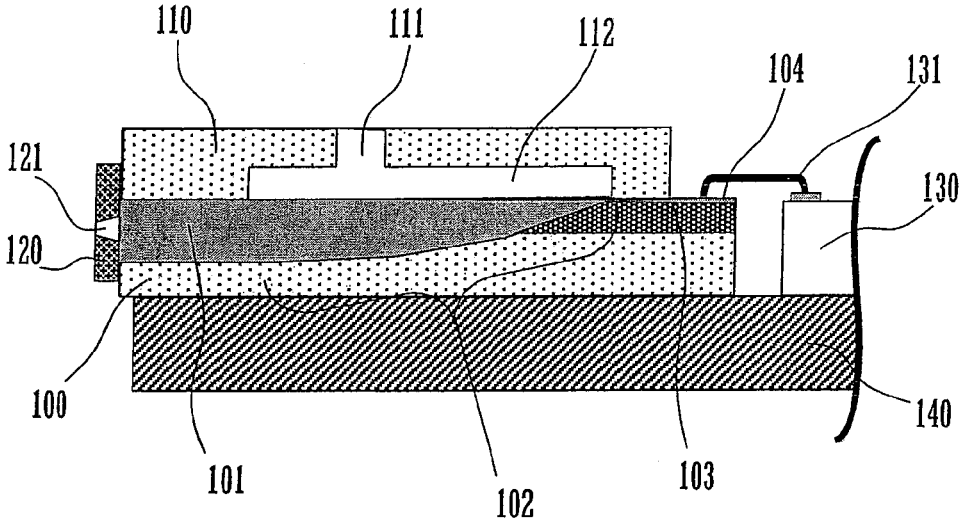
FIG. 13 PRIOR ART
FIG. 13 is a cross-sectional diagram illustrating one example of a conventional ink jet head.
Figure 14A:
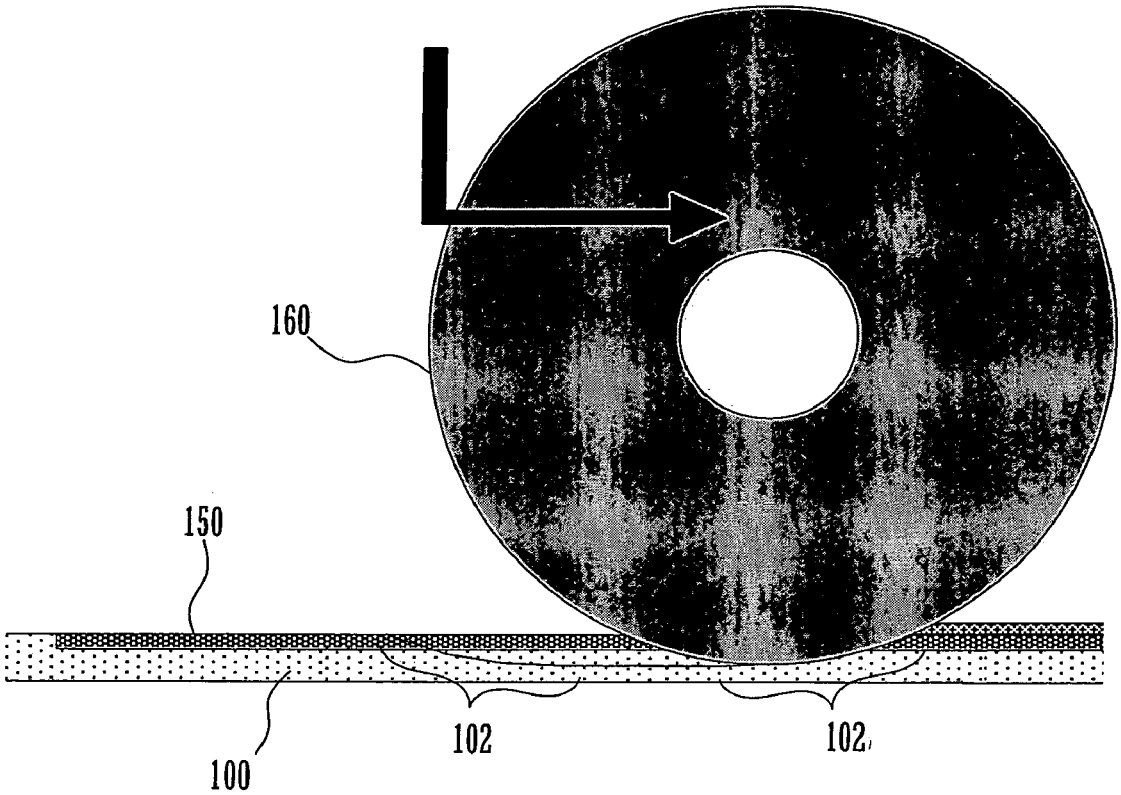
FIGS. 14A and 14B show explanatory diagrams illustrating a method of manufacturing the conventional ink jet head.
Figure 14B:
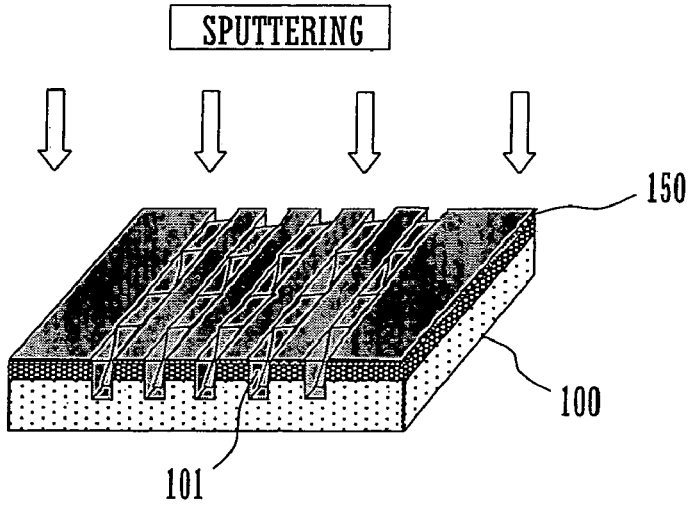
Figure 15:
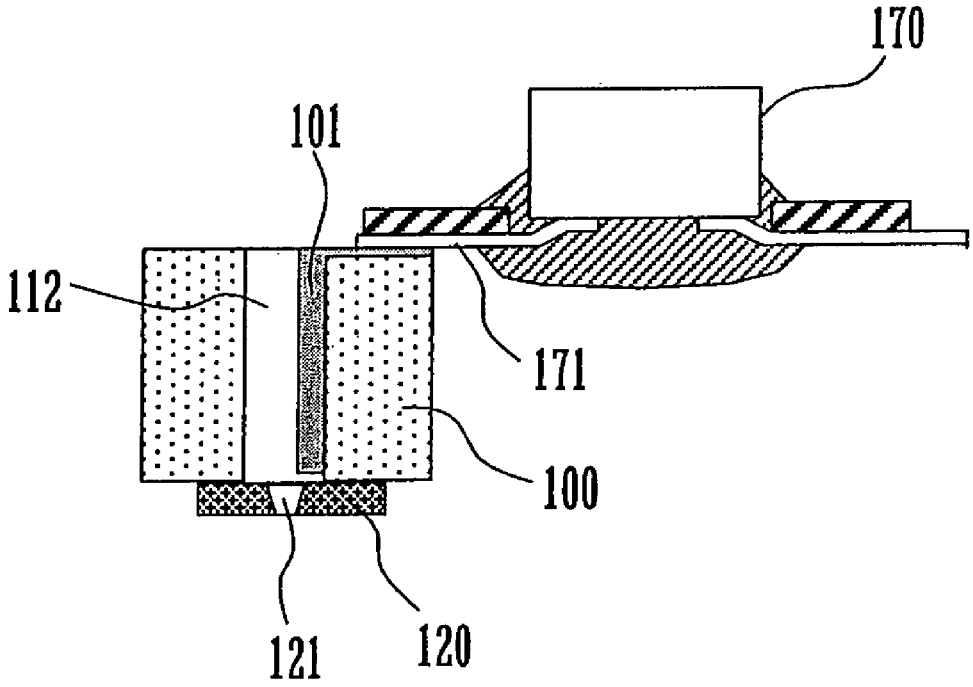
FIG. 15 PRIOR ART
FIG. 15 is a cross-sectional diagram illustrating a different example of a conventional ink jet head.
Figure 16B:
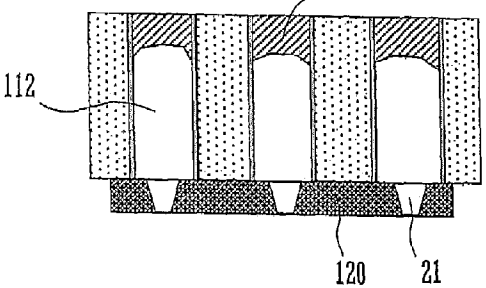
FIG. 16B PRIOR ART
FIGS. 16A, 16B and 16C show cross-sectional diagrams illustrating another example of a conventional ink jet head.
Figure 16A:
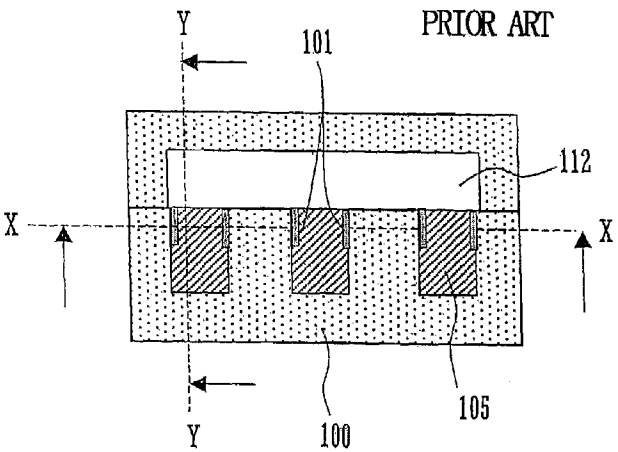
FIG. 16A PRIOR ART
Figure 16C:
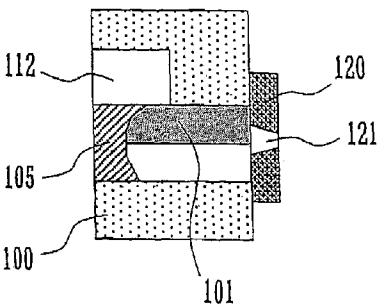
FIG. 16C PRIOR ART

Next, the ink chamber wafer 75 in which the ink chamber array has been formed and the cover wafer 79 are bonded with a commercially available adhesive as shown in a cross-sectional view of FIG. 12B. At this time, part of the filled upper surfaces 29 of the electrically conductive resin 10 and the ink chambers 22 are sealed by the cover wafer 79 (cover member 45) on the inside of rear end portions of the ink chambers. Thus, unlike the case of the aforementioned first embodiment, the ink is supplied through the through hole 77 (ink supply opening 44) in the cover member 45, and connections to external circuit electrodes are established later by portions of the filled upper surfaces 29 of the electrically conductive resin 10 excluding areas of the filled upper surfaces 29 of the electrically conductive resin 10 bonded to the cover member 45.

Subsequently, each of the external circuit connecting electrodes 12 is exposed directly upward by removing only the portions of the cover wafer 79, located on the spot faced parts 78 which are located at positions clear of the external circuit connecting electrodes 12 along dicing lines shown by broken lines in FIG. 12B by performing a dicing operation. At the same time, an assembly of the ink chamber wafer 75 and the cover wafer 79 which have been bonded together is divided into small segments to produce individual actuators 28 by cutting the assembly at the portions of the spot faced parts 78 in the cover wafer 79 and at the middle of ink chamber actuating portions where the top of the ink chambers 22 sealed as shown by thick broken lines by means of an unillustrated dicing blade of a dicer, whereby the actuators 28 are completed.

In this embodiment, the external circuit connecting electrodes of the ink jet head are formed on the exposed surface regions of the electrically conductive material at the upper parts thereof, the electrically conductive material being filled in the ink chamber array. Thus, it is possible to achieve a reduction in materials cost. In addition, since capacitance is reduced, driving frequency can be increased and, therefore, it becomes possible to perform high-speed printing. Also, since driving voltage can be decreased, it becomes possible to lower withstand voltage of the driving IC, making it possible to achieve a cost reduction of the driving IC and a reduction in power consumption for driving the same.

Furthermore, since the exposed surface regions of the electrically conductive material at the upper parts thereof filled in the ink chamber array are used as external circuit connecting electrodes, it is possible to secure desired electrode areas along the longitudinal direction of the ink chamber array for establishing electrical connections with the external circuit electrodes. Therefore, it is possible to establish electrical connections between the ink jet head and the external circuit electrodes through the connecting electrodes having large areas with low connecting resistance in a stable fashion even if the ink jet head is a narrow-pitch ink jet head. This makes it possible to ensure excellent environmental reliability and transmit a stable driving waveform to the ink jet head at a high frequency, so that it becomes possible to perform high-speed printing.

The aforementioned ink jet head can be produced by a manufacturing method including at least the following processes. Specifically, the ink jet head can be produced by a manufacturing procedure including a process of forming ink chamber grooves at specific intervals in a piezoelectric material wafer of which piezoelectric properties have been oriented along a thickness direction, a process of forming driving electrodes on the inside of the aforementioned ink chamber grooves, a process of filling electrically conductive material in the aforementioned ink chamber grooves in such a manner that the electrically conductive material connects to the electrodes on the inside of the aforementioned ink chamber grooves, a process of curing the aforementioned electrically conductive material, a process of bonding the piezoelectric material wafer and a cover wafer in such a manner that an empty space is formed on at least part of upper parts of the aforementioned filled electrically conductive material, and a process of dividing the aforementioned bonded piezoelectric material wafer into small segments after removing at least part of the cover wafer above the upper parts of the aforementioned filled electrically conductive material.

In the ink jet head produced by the aforementioned manufacturing method, the exposed surface regions of the electrically conductive material at the upper parts of the electrically conductive material filled in the ink chamber array are used as external circuit connecting electrodes, so that it is possible to secure desired electrode areas along the longitudinal direction of the ink chamber array. Thus, electrical connections to an external circuit can be established by the connecting electrodes having large areas, so that it is possible to connect them with low connecting resistance in a stable fashion even if the ink jet head is a narrow-pitch ink jet head. This makes it possible to ensure excellent environmental reliability and transmit a stable driving waveform to the driving electrodes at a high frequency, so that it becomes possible to perform high-speed printing.

It is to be noted that the present invention is not limited to the individual embodiments thus far described. Design changes, improvements and process changes may be freely implemented without departing from the spirit of the invention.

It is apparent from the foregoing discussion that, although internal electrodes of individual ink chambers have been extended to the outside of the ink chambers to allow the mounting of the ink jet head in the prior art, it becomes unnecessary to extend the electrodes outward and portions other than active areas of the actuator become almost unnecessary. As a consequence, it becomes possible to achieve a size reduction of the actuator and realize a significant reduction in materials cost.

Also, the capacitance of the ink jet head decreases due to the significant reduction of the portions other than the active areas. For this reason, driving frequency can be increased, so that it becomes possible to realize high-speed printing. In addition, since driving voltage can be reduced, it becomes possible to lower withstand voltage of the driving IC, making it possible to realize a cost reduction of the driving IC and a reduction in power consumption for driving the same.

Furthermore, since each of the external circuit connecting electrodes made of the filled electrically conductive material has a cross-sectional area larger than the cross-sectional area of each ink chamber, it is possible to establish electrical connections between the ink jet head and the external circuit electrodes with low connecting resistance through large areas in a stable fashion even if the ink jet head is a narrow-pitch ink jet head. This makes it possible to ensure excellent environmental reliability and transmit a stable driving waveform to the driving electrodes at a high frequency, so that it becomes possible to perform high-speed printing.

Also, in the ink jet head module of the present invention, each of the exposed surface regions of the electrically conductive material, that is, the external circuit connecting electrodes, are electrically connected to the external circuit via anisotropic conductive material by means of at least 5 electrically conductive particles contained in the anisotropic conductive material for the connection between the ink jet head and the external circuit.

Accordingly, there exist sufficient quantities of electrically conductive particles contained in the anisotropic conductive material in the electrical connections between the ink jet head and the external circuit and, therefore, it is possible to connect the ink jet head to the external circuit in a stable manner with low connecting resistance and small variations in the connecting resistance. This makes it possible to ensure excellent environmental reliability and transmit a stable driving waveform to the driving electrodes at a high frequency, so that it becomes possible to perform high-speed printing.

Also, since the area of each connecting part connected to the external circuit of the ink jet head module is larger than the area of each of the external circuit connecting electrodes of the ink jet head, a large margin for positioning error can be secured in making electrical connections, so that it is possible to use the entirety of the external circuit connecting electrodes for establishing the electrical connections in a stable fashion.

As a result, it is possible to realize an improvement in productivity and make stable connections to the external circuit with low connecting resistance and small variations in the connecting resistance. Also, it is possible to ensure excellent environmental reliability and transmit a stable driving waveform to the driving electrodes at a high frequency, so that it becomes possible to perform high-speed printing.

In the ink jet head produced by the manufacturing method of the present invention, each of the external circuit connecting electrodes for establishing connections to the external circuit has a cross-sectional area larger than that of each ink chamber as measured in a groove width direction, the external circuit connecting electrodes being formed on the exposed surface regions of the electrically conductive material filled in the grooves connected to the ink chambers at the rear end portion of the head.

Accordingly, although internal electrodes of individual ink chambers have been extended to the outside of the ink chambers to allow the mounting of the ink jet head in the prior art, it becomes unnecessary to extend the electrodes outward and portions other than active areas of the actuator become almost unnecessary. As a consequence, it becomes possible to achieve a size reduction of the actuator and realize a significant reduction in materials cost.

Since portions other than the active areas become almost unnecessary, it also becomes possible to reduce the capacitance. As a result of this reduction in the capacitance, driving frequency can be increased, making it possible to perform high-speed printing. In addition, since driving voltage can be reduced and withstand voltage of the driving IC can be lowered, it becomes possible to achieve a cost reduction of the driving IC and a reduction in power consumption for driving the same.

Since the aforementioned procedure includes, in particular, a process of forming partially deepened deep groove portions formed in the ink chambers at the rear end portion of the head and a process of filling the electrically conductive material in the deep groove portions, each of the external circuit connecting electrodes made of the electrically conductive material filled in the deep groove portions has a cross-sectional area larger than that of each ink chamber. Therefore, the external circuit connecting electrodes can be electrically connected to the external circuit in a stable fashion at a later time, and the ink jet head can be electrically connected to the external circuit through large areas even if the ink jet head is a narrow-pitch ink jet head.

Since the electrical connections can be established with low connecting resistance in a stable manner, it possible to ensure excellent environmental reliability and transmit a stable driving waveform to the driving electrodes at a high frequency. As a result, it becomes possible to provide an ink jet head having the high-speed printing capability.

The invention claimed is:

1. An ink jet head comprising:

a plurality of ink chambers arranged like parallel grooves; walls separating said multiple ink chambers;

driving electrodes provided on said walls, said driving electrodes being exposed individually in said multiple ink chambers;

external circuit connecting electrodes provided individually for said multiple ink chambers for connecting said driving electrodes to an external circuit; and electrically conductive material filled in each of said multiple ink chambers;

wherein said external circuit connecting electrodes are individually formed on exposed surface regions of the electrically conductive material filled in said ink chambers at a rear end portion of the head where individual strips of said electrically conductive material are exposed, and the area of each of said external circuit connecting electrodes is made larger than the cross-sectional area of each of said multiple ink chambers as measured in a groove width direction.

2. The ink jet head as recited in claim 1, wherein said electrically conductive material is filled in partially deepened deep groove portions formed in said ink chambers at said rear end portion of the head.

3. The ink jet head as recited in claim 1, wherein said electrically conductive material is filled in partially widened wide grooves formed in said ink chambers at said rear end portion of the head.

4. The ink jet head as recited in claim 1, wherein the area of each of the exposed surface regions of said electrically conductive material is at least 3960 μm2.

5. An ink jet head comprising:

a plurality of ink chambers arranged like parallel grooves; walls separating said multiple ink chambers;

driving electrodes provided on said walls, said driving electrodes being exposed individually in said multiple ink chambers;

external circuit connecting electrodes provided individually for said multiple ink chambers for connecting said driving electrodes to an external circuit; and electrically conductive material filled in each of said multiple ink chambers;

wherein said external circuit connecting electrodes are individually formed on exposed surface regions of the electrically conductive material filled in said ink chambers at a rear end portion of the head where individual strips of said electrically conductive material are exposed, and the area of each of said external circuit connecting electrodes is made larger than the cross-sectional area of each of said multiple ink chambers as measured in a groove width direction; and wherein each of said external circuit connecting electrodes formed on said exposed surface regions is electrically connected to said external circuit by at least 5 electrically conductive particles contained in anisotropic conductive material.

6. The ink jet head as recited in claim 5, wherein the area of each connecting part connected to said external circuit is made larger than the area of each of said external circuit connecting electrodes.

* * * * *